US011982069B2

(12) United States Patent
Nakayama et al.

(10) Patent No.: US 11,982,069 B2
(45) Date of Patent: May 14, 2024

(54) WORK VEHICLE

(71) Applicant: HITACHI CONSTRUCTION MACHINERY CO., LTD., Tokyo (JP)

(72) Inventors: Atsushi Nakayama, Akashi (JP); Tsukasa Ikeuchi, Kobe (JP); Atsushi Ninomiya, Oume (JP); Katsumi Usami, Abiko (JP); Yusuke Daimon, Tokyo (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 530 days.

(21) Appl. No.: 17/274,211

(22) PCT Filed: Nov. 27, 2019

(86) PCT No.: PCT/JP2019/046398
§ 371 (c)(1),
(2) Date: Mar. 8, 2021

(87) PCT Pub. No.: WO2020/137324
PCT Pub. Date: Jul. 2, 2020

(65) Prior Publication Data

US 2021/0355655 A1 Nov. 18, 2021

(30) Foreign Application Priority Data

Dec. 27, 2018 (JP) ..... 2018-245676

(51) Int. Cl.
*E02F 9/16* (2006.01)
*E02F 9/20* (2006.01)

(52) U.S. Cl.
CPC ..... *E02F 9/16* (2013.01); *E02F 9/2004* (2013.01)

(58) Field of Classification Search
CPC ... E02F 9/16; E02F 9/2004; E02F 3/16; E02F 9/20; E02F 9/2025
See application file for complete search history.

(56) References Cited

U.S. PATENT DOCUMENTS 5,244,066 A 9/1993 Mackoway et al.
9,663,917 B2 * 5/2017 Fujii ..... E02F 3/3677
(Continued)

FOREIGN PATENT DOCUMENTS

CN 102561440 A 7/2012
JP 06-033875 U 5/1994
(Continued)

OTHER PUBLICATIONS

International Search Report of PCT/JP2019/046398 dated Mar. 3, 2020.

*Primary Examiner* — Amy R Weisberg
*Assistant Examiner* — Sara Laghlam
(74) *Attorney, Agent, or Firm* — MATTINGLY & MALUR, PC

(57) ABSTRACT

This invention provides a work vehicle in which operating switches are easy to operate even in a situation where the vehicle is shaken. In a wheel loader 1 including a working device 2 and a cab 3, wherein the cab 3 is provided with a driver's seat 51, a pair of front pillars 331L, 331R, an operating lever 54 for operating the working device 2, and a switchbox 55 having an operating surface 550 in which multiple operating switches S are arranged, the operating lever 54 is placed between a right front pillar 331R and the driver's seat 51, the switchbox 55 is installed to the right front pillar 331R with its long side direction being along the pillar extension direction, the operating surface 550 is oriented toward a direction along an imaginary line IL that passes through the center in its short side direction and extends perpendicular to the surface, the imaginary line
(Continued)

intersecting a backrest of the driver's seat 51 and a center line C with respect to the left and right direction of the cab 3, and one side of the switchbox 55 in a short side direction has a guide 553 formed to overhang out along its long side direction.

3 Claims, 7 Drawing Sheets

(56) References Cited

U.S. PATENT DOCUMENTS

| | | | | |
|---|---|---|---|---|
| 10,422,111 | B2 * | 9/2019 | Yamada | E02F 9/264 |
| 2015/0345114 | A1 * | 12/2015 | Nomura | E02F 5/025 37/379 |
| 2023/0038266 | A1 * | 2/2023 | Kean | E02F 3/435 |
| 2023/0235537 | A1 * | 7/2023 | Bae | E02F 9/2292 60/486 |

FOREIGN PATENT DOCUMENTS

| | | | | |
|---|---|---|---|---|
| JP | 06-155347 | A | 6/1994 | |
| JP | 3447736 | B2 | 3/1995 | |
| JP | 08-002042 | Y2 | 1/1996 | |
| JP | 3447736 | B2 * | 9/2003 | B60N 2/797 |
| JP | 2013-021975 | A | 2/2013 | |
| JP | 2013021975 | A * | 2/2013 | |
| JP | 2016-003136 | A | 1/2016 | |
| JP | 2018-117565 | A | 8/2018 | |
| JP | 2018117565 | A * | 8/2018 | |

* cited by examiner

WORK VEHICLE

TECHNICAL FIELD

The present relate to a work vehicle equipped with a switchbox having various operating switches arranged therein inside a cab.

BACKGROUND ART

Heretofore, a work vehicle is known in which, as a layout inside its cab, various operating switches and a panel or the like for displaying a suite of instruments are placed forward of a driver's seat to allow an operator sitting on the driver's seat to easily perform operation and make visual recognition, while facing forward. For example, in Patent Literature 1, a combine is disclosed in which a work operation panel is installed to one front pillar of a pair of left and right front pillars provided in a front part of a driving cabin. The work operation panel is installed to the one front pillar so that it is positioned to overlap the one front pillar in a projection direction from a central position of the surface of the driver's seat toward the one front pillar and its operating surface is oriented toward the driver's seat.

CITATION LIST

Patent Literatures

Patent Literature 1: Japanese Patent Application Laid-Open No. 2013-21975

SUMMARY OF INVENTION

Technical Problem

The placement of the work operation panel in the combine described in Patent Literature 1 can be applied also to a work vehicle performing a loading operation, such as a wheel loader. Such a work vehicle often travels on a heavily rough road surface and tends to be shaken greatly during traveling, and this makes it hard for the operator to position his or her finger on an operating switch that he or she wants to operate due to the influence of shaking movement among others. Hence, it would be hard for the operator to operate operating switches, and there is also a possibility of operating a wrong operating switch or the like by mistake.

It is therefore an object of the present invention to provide a work vehicle in which operating switches are easy to operate even in a situation where the vehicle is shaken.

Solution to Problem

To achieve the foregoing object, the present invention resides in a work vehicle including a working device installed on a frame structure constituting a vehicle body and a cab mounted on the frame structure, wherein the cab is provided with a driver's seat mounted on a floorboard, a pair of pillars extending in a vertical direction between a ceiling and the floorboard at left and right sides in front of the driver's seat, an operating lever for operating the working device, and a switchbox having an operating surface in which multiple operating switches are arranged. The work vehicle is characterized as below: the operating lever is placed between one pillar of the pair of pillars and the driver's seat in left and right direction of the cab; the switchbox is installed to the one pillar with its long side direction being along the pillar extension direction; the operating surface is oriented toward a direction along an imaginary line that passes through the center in its short side direction and extends perpendicular to the surface, the imaginary line intersecting a backrest of the driver's seat and a center line with respect to the left and right direction of the cab; and one side of the switchbox in a short side direction has a guide formed to overhang out along the long side direction.

Advantageous Effects of Invention

According to the present invention, it is easy to operate operating switches even in a situation where the vehicle is shaken. Problems, structures, and advantageous effects other than those described above will be made apparent from the following description of an embodiment.

DESCRIPTION OF EMBODIMENT

As one aspect of a work vehicle pertaining to an embodiment of the present invention, a wheel loader is described below, the wheel loader performing a loading operation that excavates earth and sand, minerals, etc. and loads them into a dump truck or the like, e.g., in an open pit mine or the like.

(Overall Structure of the Wheel Loader 1)

First, an overall structure of the wheel loader 1 is described with reference to FIG. 1.

Figure 1:
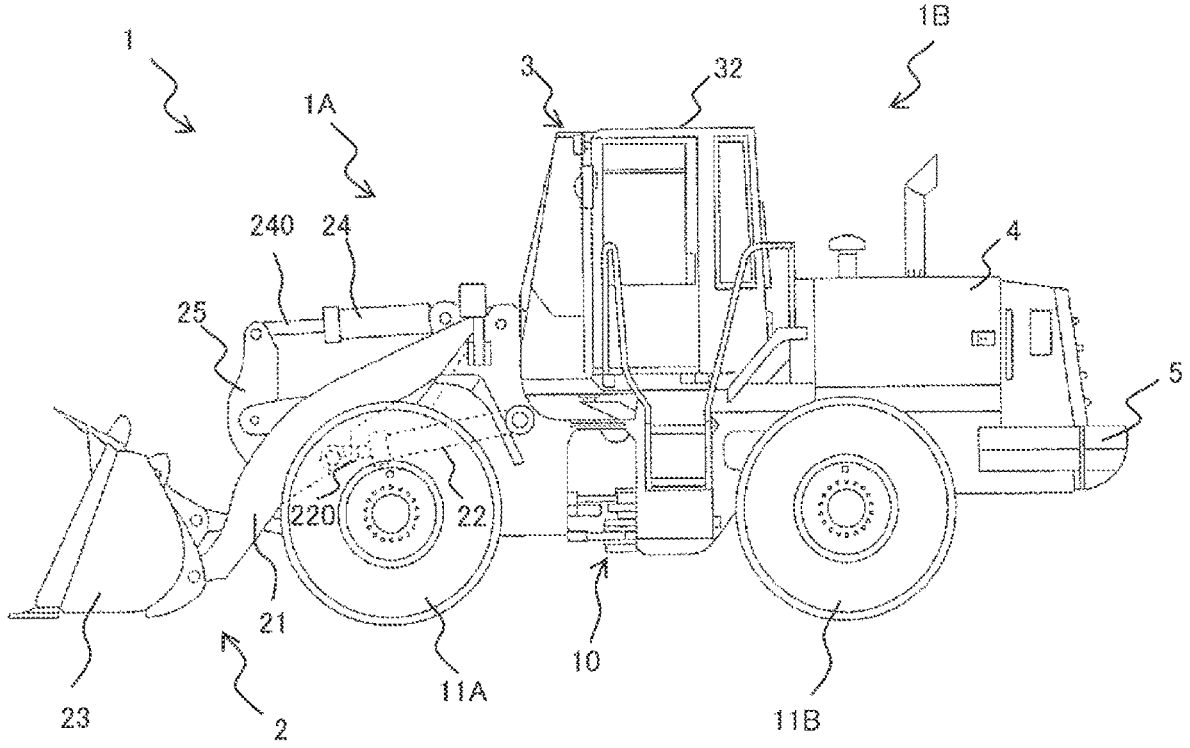
FIG. 1 is a side view depicting an external appearance of a wheel loader pertaining to an embodiment of the present invention.

FIG. 1 is a side view depicting an external appearance of the wheel loader 1 pertaining to an embodiment of the present invention.

The wheel loader 1 includes a front frame 1A forming a front part of its body, a rear frame 1B forming a rear part of its body, a working device 2 installed on the front frame 1A, and a cab 3 mounted on the rear frame 1B. The wheel loader 1 is an articulated work vehicle in which steering is accomplished by bending the vehicle about a pivotal point near the center of its body. The front frame 1A and the rear frame 1B are interconnected by a center joint 10 to be turnable in left and right direction and the front frame 1A can bend in left and right direction with respect to the rear frame 1B.

A pair of right and left front wheels 11A and a pair of right and left rear wheels 11B are disposed in the front frame 1A and the rear frame 1B, respectively. Note that only a front wheel 11A and a rear wheel 11B which are left ones of the pairs of right and left front wheels 11A and rear wheels 11B are depicted in FIG. 1.

The working device 2 includes a lift arm 21 installed on the front frame 1A, a pair of lift arm cylinders 22 allowing the lift arm 21 to turn in a vertical direction with respect to the front frame 1A, a bucket 23 installed at the forward end of the lift arm 21, a bucket cylinder 24 allowing the bucket 23 to turn in a vertical direction with respect to the lift arm 21, a bell crank 25 that is turnably connected to the lift arm 21 and forms a link mechanism between the bucket 23 and the bucket cylinder 24, and multiple pipes (not depicted) guiding pressure oil to the pair of lift arm cylinders 22 and the bucket cylinder 24. Note that one of the pair of lift arm cylinders 22, only a lift arm cylinder 22 placed on the left is depicted with dashed lines in FIG. 1.

The lift arm 21 makes an upward turning movement with extension of the rods 220 of the pair of lift arm cylinders 22 and makes a downward turning movement with shortening of the rods 220. The bucket 23 tilts (making an upward turning movement with respect to the lift arm 21) with extension of the rod 240 of the bucket cylinder 24 and dumps (making a downward turning movement with respect to the lift arm 21) with shortening of the rod 240.

The rear frame 1B is provided with a machine room 4 housing respective components such as an engine and hydraulic pumps inside it and a counterweight 5 for keeping a balance with the working device 2 to prevent the vehicle body from inclining, besides the cab 3. In the rear frame 1B, the cab 3 is placed in a forward part, the counterweight 5 is placed is in a rear part, and the machine room 4 is placed between the cab 3 and the counterweight 5.

(Structure of the Cab 3)

Then, the structure of the cab 3 is described with reference to FIGS. 2 to 5.

Figure 2:
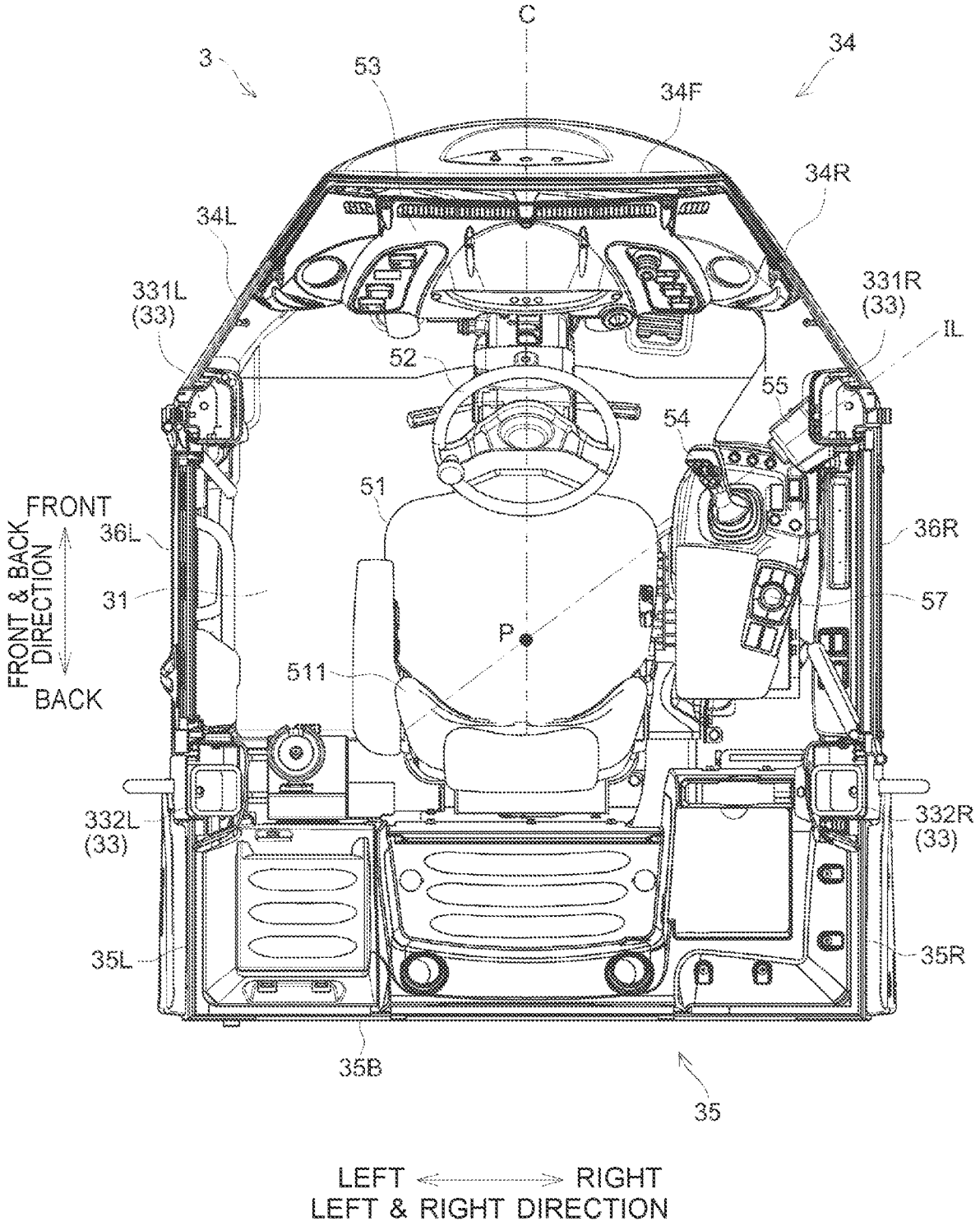
FIG. 2 is a diagram depicting an interior of a cab when viewed from its ceiling.
Figure 3:
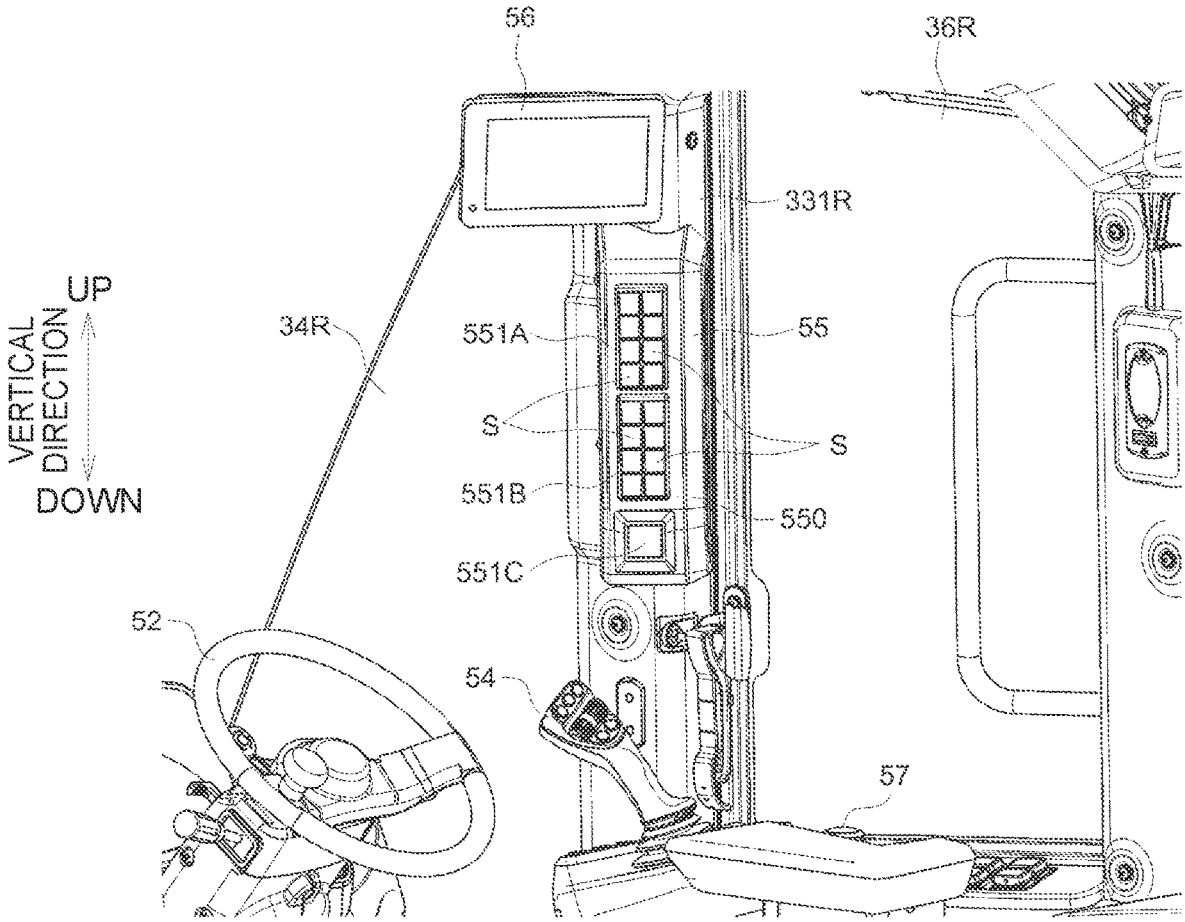
FIG. 3 is a view inside the cab, diagonally forward right from a driver's seat, when viewed along an imaginary line.
Figure 4:
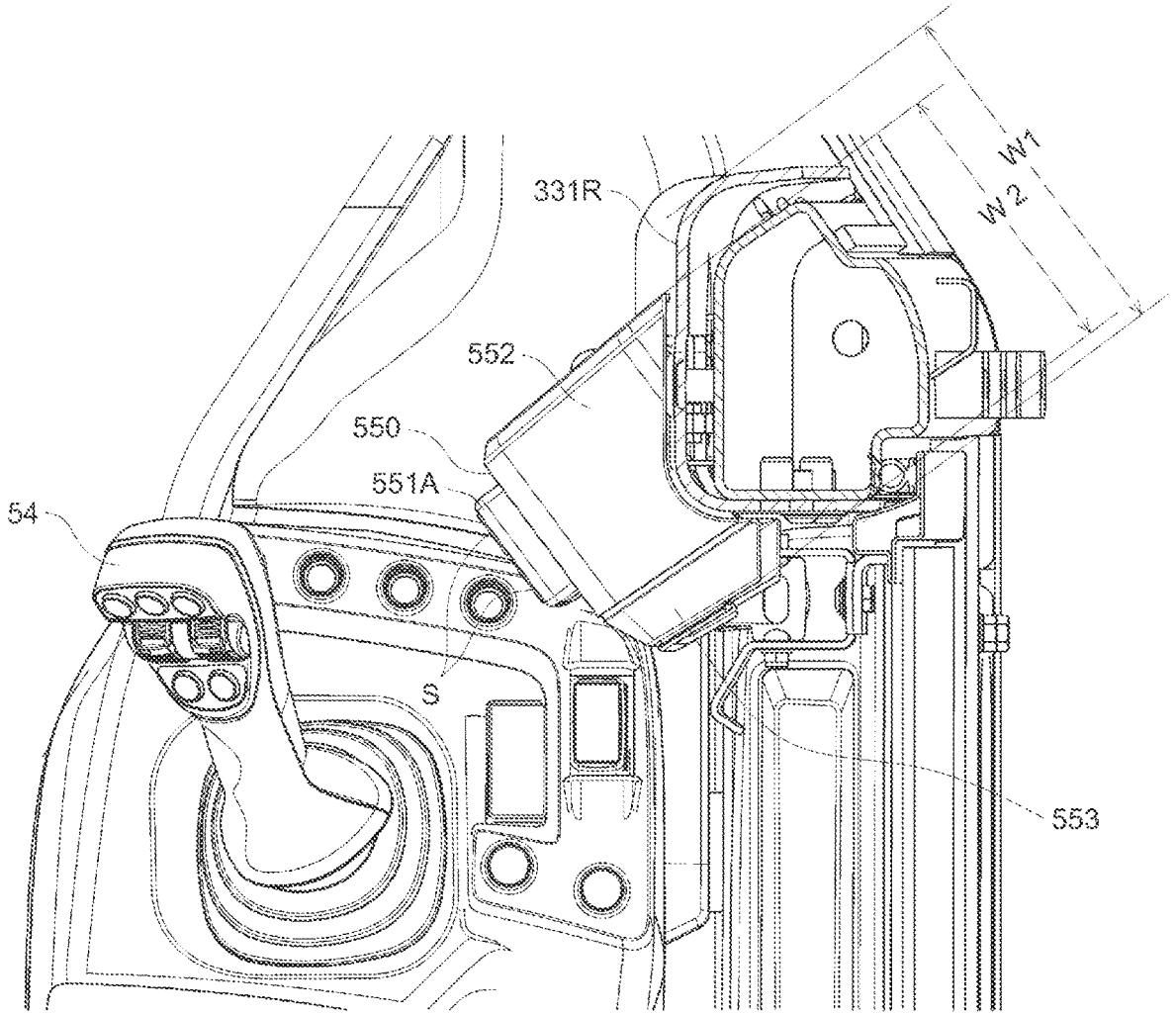
FIG. 4 is a diagram depicting interior parts around a right front pillar when viewed from the ceiling.
Figure 5:
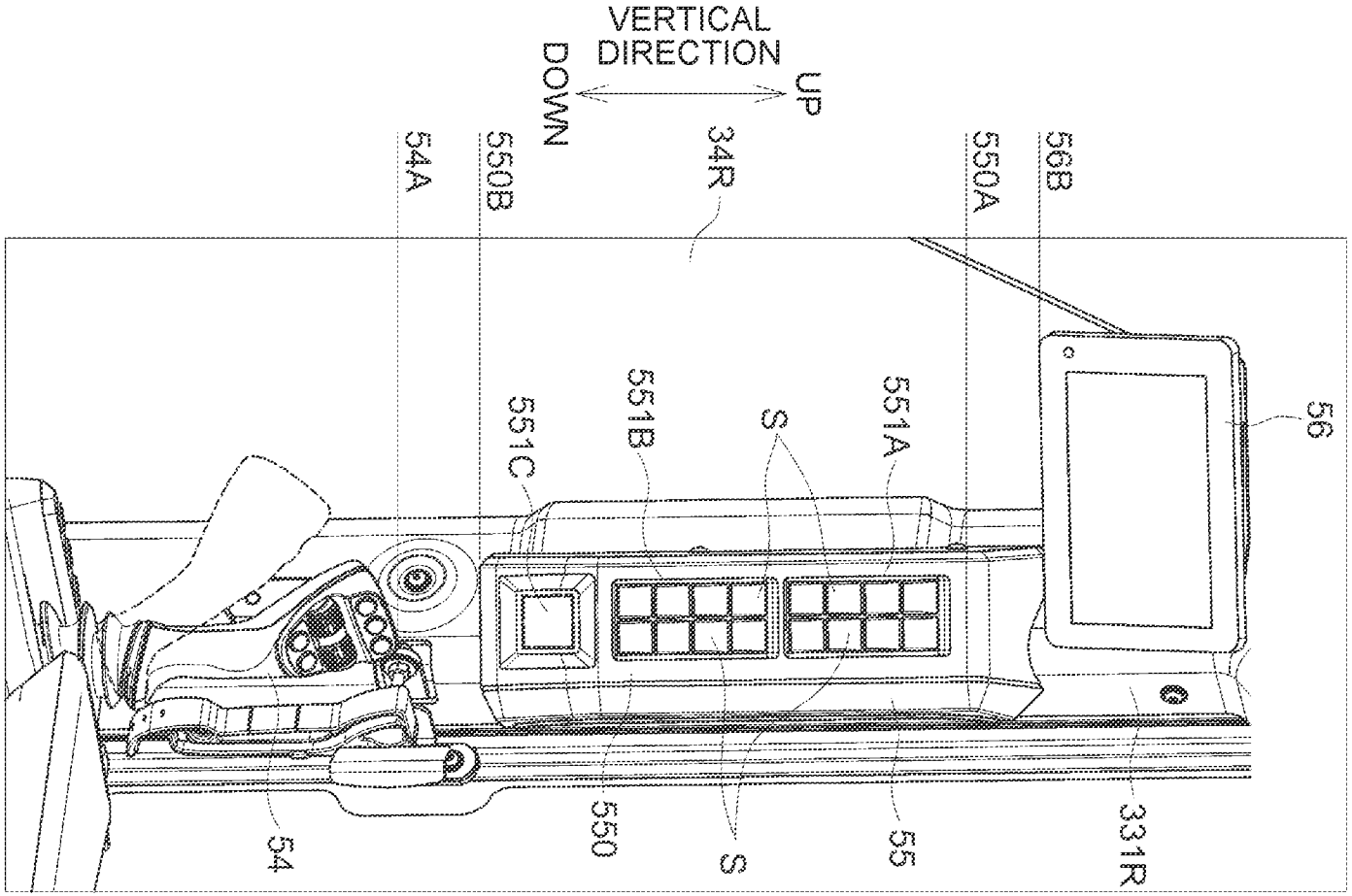
FIG. 5 is an enlarged view of the interior parts around the right front pillar in FIG. 3.

FIG. 2 is a diagram depicting an interior of the cab 3 when viewed from its ceiling 32. FIG. 3 is a view inside the cab 3, diagonally forward right from a driver's seat, when viewed along an imaginary line IL. FIG. 4 is a diagram depicting interior parts around a right front pillar 331R when viewed from the ceiling 32. FIG. 5 is an enlarged view of the interior parts around the right front pillar 331R in FIG. 3.

As depicted in FIG. 2, the cab 3 has a framework provided with a floorboard 31 mounted on the rear frame 1B, the ceiling 32 (see FIG. 1) covering above the floorboard 31, and multiple pillars 33 extending in a vertical direction between the floorboard 31 and the ceiling 32, and a space for an operator to ride in the vehicle is formed inside the cab.

Then, as depicted in FIG. 2 and FIG. 3, inside the cab 3, there are provided a driver's seat 51 situated on the floorboard 31, a steering wheel 52 placed in front of the driver's seat 51 and used to change a direction of travel of the vehicle body to the left or right, a front panel 53 placed in front of the steering wheel 52, an operating lever 54 used for operating the working device 2, a switchbox 55 having an operating surface 550 in which multiple operating switches S are arranged, and a sub-monitor 56 for the operator to see in the rear of the vehicle body.

In the present embodiment, as depicted in FIG. 2, a set of the multiple pillars 33 is comprised of a pair of front pillars 331L, 331R placed left and right in front of the driver's seat 51 and a pair of rear pillars 332L, 332R placed on left and right sides of a backrest 511 of the driver's seat 51, a total of four pillars. Note that the pair of front pillars 331L, 331R corresponds to a pair of pillars extending in a vertical direction between the ceiling 32 and the floorboard 31 at left and right in front of the driver's seat 51.

Note that the following description assumes that, as for left and right direction of the vehicle body of the wheel loader 1, the direction of a left hand of an operator sitting on the driver's seat 51, facing the front (forward), is a "left direction" and the direction of a right hand of the operator is a "right direction". Also, in the following, "left and right direction of the vehicle body" may simply be written as "left and right direction" and "front and back direction of the vehicle body" may simply be written as "front and back direction".

A front window glass 34 is provided so as to bulge out toward the working device 2 between the pair of front pillars 331L, 331R. The front window glass 34 is comprised including a front portion 34F positioned in front of the operator, a left front portion 34L positioned at left forward of the operator, and a right front portion 34R positioned at right forward of the operator. A lateral width of the front portion 34F is smaller than a distance between the pair of front pillars 331L, 331R. The left front portion 34L slants from the left front pillar 331L toward the front portion 34F and the right front portion 34R slants from the right front pillar 331R toward the front portion 34F. That is, the left front portion 34L and the right front portion 34R are provided so as to slant from outer edges in the left and right direction toward the middle front portion.

A rear window glass 35 is provided so as to bulge out toward the machine room 4 between the pair of rear pillars 332L, 332R. The rear window glass 35 is comprised including a back portion 35B positioned in the back of the operator, a left back portion 35L positioned at left backward of the operator, and a right back portion 35R positioned at right backward of the operator. A lateral width of the back portion 35B of the rear window glass 35 is the same as a distance between the left back portion 35L and the right back portion 35R. Therefore, the left back portion 35L and the right back portion 35R are provided so as to be parallel along the front and back direction of the vehicle body.

Opening and closing doors 36L, 36R for an operator, worker, or the like to enter the cab 3 are provided between the left front pillar 331L and the left rear pillar 332L and between the right front pillar 331R and the right rear pillar 332R, respectively. In the present embodiment, a left opening and closing door 36L is set in a state that it can be opened and closed, and the operator is to enter the cab 3 from the left opening and closing door 36L; however, a right opening and closing door 36R may be set in a state that it can be opened and closed depending on specifications of the wheel loader 1.

The front panel 53 is comprised including various operating buttons regarding, e.g., vehicle body traveling and a main monitor or the like for displaying, vehicle body traveling conditions, or the like. The operating lever 54 is placed between the right front pillar 331R with respect to left and right direction of the cab 3 and the driver's seat 51. In the present embodiment, the operating lever 54 is a multi-axis lever that can be operated in front, back, left and right direction in a range of 360° and is used for operating the working device 2 and, besides, for changing over forward direction and backward direction in which the vehicle body travels.

As depicted in FIG. 3, the switchbox 55 is installed to the right front pillar 331R with its long side direction being along the pillar extension direction. Furthermore, as depicted in FIG. 2, the operating surface 550 is oriented toward a direction along the imaginary line IL (drawn as a two-dot chain line in FIG. 2) that passes through the center in its short side direction and extends perpendicular to the surface. The imaginary line IL intersects the backrest 511 of the driver's seat 51 and a center line C (drawn as a one-dot chain line in FIG. 2) with respect to left and right direction of the cab 3. In this regard, note that the operator's eye point is on an upward extension from an intersection point P between the imaginary line IL and the center line C.

The switchbox 55 is thus installed to the right front pillar 331R such that the operating surface 550 is oriented toward the operator sitting on the driver's seat 51. Therefore, the operator can operate the operating switches S while facing the front, without changing his or her posture or face orientation significantly and there is good operability.

In the present embodiment, each of a pair of switch panels 551A, 551B is comprised of eight operating switches S in total; four operating switches S arrayed in a longitudinal (vertical) direction of the operating surface 550 stand side by side in two columns in a lateral direction. As depicted in FIG. 3 and FIG. 5, the pair of switch panels 551A, 551B is disposed to line up and down with a gap in between in the longitudinal direction of the operating surface 550. Note that, in the pair of switch panels 551A, 551B, a switch panel 551A placed upper is referred to as an upper switch panel 551A and a switch panel 551B placed lower is referred to as a lower switch panel 551B.

16 operating switches S are the switches for driving each device and equipment mounted in the wheel loader 1, e.g., for activation of a wiper and a washer and manual regeneration of exhaust gas treatment equipment. Additionally, in the operating surface 550, an adjuster 551C for adjusting the angle of an electric mirror (not depicted) mounted on the vehicle body is disposed below the lower switch panel 551B.

As depicted in FIG. 4, in the present embodiment, when the switchbox 55 and the right front pillar 331R are viewed along the imaginary line IL (see FIG. 2), a width W2 of the switchbox 55 is smaller than a width W1 of the right front pillar 331R (W2<W1). This enables the operator sitting on the driver's seat 51 to have a wide field of view. Moreover, the operator usually grabs the operating lever 54 with his or her right hand, and it is easy for the operator to access the switchbox 55 from when he or she grabs the operating lever 54 with the right hand, since the switchbox 55 is installed to the right front pillar 331R which is the front pillar in a side where the operating lever 54 is placed.

As depicted in FIG. 3 and FIG. 5, the sub-monitor 56 is one aspect of a display device and displays content that is imaged by a back camera installed on the rear of the vehicle body; besides, it also displays, inter alia, the current setup status of the vehicle body with regard to, e.g., tuning of the vehicle body. Note that tuning of the vehicle body is performed using a dial type operation unit 57 (see FIG. 2 and FIG. 3) placed on the right side behind the operating lever 54.

As depicted in FIG. 3, the sub-monitor 56 is disposed in an upper position on the side of the right front pillar 331R, and the operating surface 550 of the switchbox 55 is placed between the bub-monitor 56 and the operating lever 54 in a vertical direction. Specifically, as depicted in FIG. 5, a top end 550A of the operating surface 550 is positioned below a bottom end 56B of the sub-monitor 56, and a bottom end 550B of the operating surface 550 is positioned above an uppermost position 54A of the operating lever 54 when raised. Note that, in the present embodiment, the operating lever 54 when bending forward is in a neutral position (as drawn with dashed lines in FIG. 4).

The operating surface 550 of the switchbox 55 is thus disposed in a position where it does not overlap with both the operating lever 54 and the sub-monitor 56 when viewed from the operator sitting on the driver's seat 51. Therefore, when operating the switchbox 55, the operator's hand will hardly touch the operating lever 54 or the sub-monitor 56 and, thus, the switchbox 55 is easy to operate.

(Structure of the Switchbox 55)

Next, a more concrete structure of the switchbox 55 is described with reference to FIG. 6 and FIG. 7.

Figure 6:
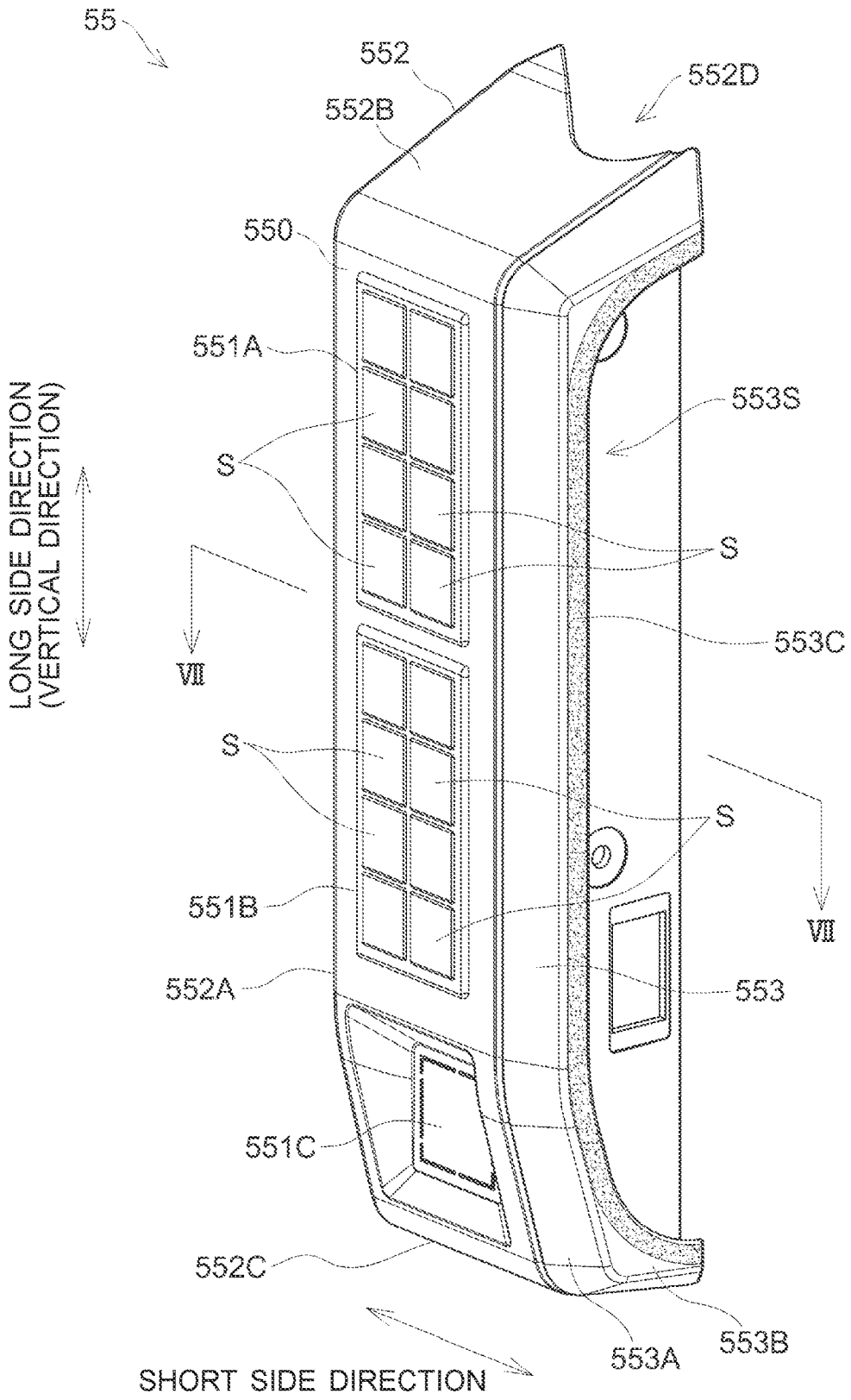
FIG. 6 is a perspective view depicting a structure of a switchbox.

FIG. 6 is a perspective view depicting the structure of the switchbox 55. FIG. 7 is a cross-sectional diagram cut along line VII-VII in FIG. 6.

The switchbox 55 is a box body formed in an elongated shape along the extension direction of the right front pillar 331R and includes a main body 552 having the operating surface 550 and a guide 553 overhanging out in one side of the main body 552 in a short side direction (a right lateral surface with the operating surface 550 facing the front). In the present embodiment, the switchbox 55 is made of resin or the like and formed by injection molding; the main body 552 and the guide 553 are formed integrally.

The main body 552 includes a front plate 552A including the operating surface 550 in which the pair of switch panels 551A, 551B and the adjuster 551C are installed, a top plate 552B and a bottom plate 552C extending in a direction opposite to the operating surface 550 from both ends (top and bottom ends) of the front plate 552A in a long side direction, and a pair of lateral plates 552R, 552L provided to stand toward the extension direction of the top plate 552B and the bottom plate 552C from both ends of the front plate 552A in a short side direction.

Figure 7:
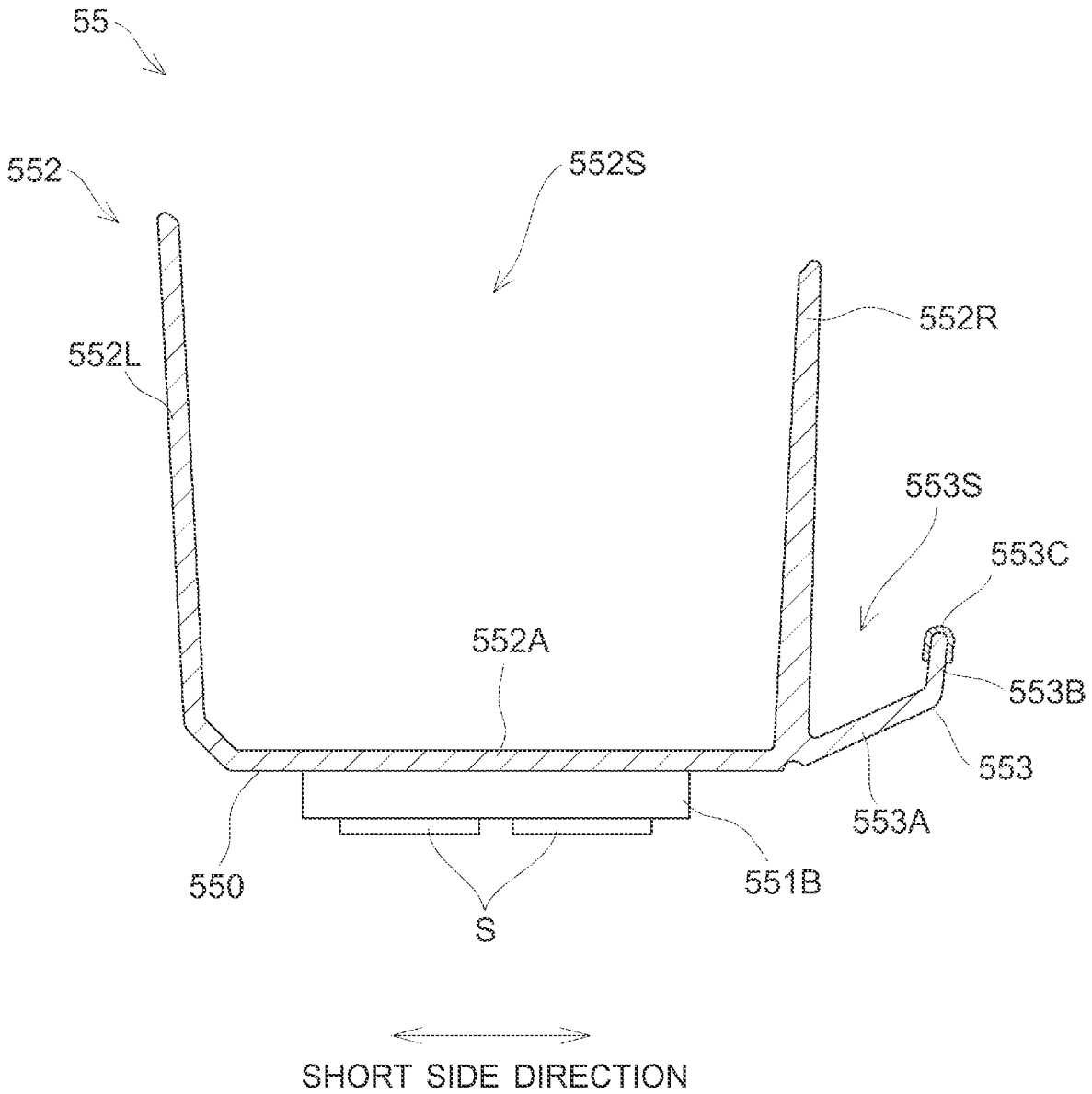
FIG. 7 is a cross-sectional diagram cut along line VII-VII in FIG. 6.

Furthermore, as depicted in FIG. 7, an internal space 552S is defined so as to be surrounded by the front plate 552A, the top plate 552B, the bottom plate 552C, and the pair of lateral plates 552R, 552L.

In addition, because the switchbox 55 is installed on a corner of the right front pillar 331R (see FIG. 2 and FIG. 4), a notch 552D mating with the shape of the corner of the right front pillar 331R is formed in the top plate 552B as depicted in FIG. 6. Note that a notch 552D is also formed in the bottom plate 522C as with the top plate 552B, though it is not depicted in FIG. 6.

As depicted in FIG. 6, the guide 553 is formed to continue along the extension direction of the top plate 552B, the long side direction of the front plate 552A, and the extension direction of the bottom plate 552C and includes an overhang part 553A overhanging from the top plate 552B, front plate 552A, and bottom plate 552C and an extension part 553B extending along one lateral plate 552R from the overhang part 553A.

As depicted in FIG. 7, in the back side of the guide 553, a recess 553S continuing along the extension direction of the guide 553 is defined so as to be surrounded by the one lateral plate 552R of the main body 552, the overhang part 553A, and the extension part 553B.

When the operator operates the switchbox 55, for example, the guide 553 allows the operator to hook four fingers other than the thumb on it and press a desired operating switch S on the operating surface 550 with the thumb. Thus, because the operator can hook four fingers other than the thumb on the guide 553, the operator can press an operating switch S with his or her hand being stabilized. Therefore, even when the operator operates the switchbox 55 under a situation where the vehicle body vibrates greatly, it would be easy for the operator to press a desired operating switch S and it can be prevented that pressing a wrong switch causes other equipment to operate erroneously.

In addition, as depicted in FIG. 6, the guide 553 is formed in a shape that continues along the long side direction of the main body 552 (the operating surface 550). Therefore, for instance, even when the operator wants to press an operating switch S in the lower switch panel 551B after pressing an operating switch S in the upper switch panel 551A, the operator can easily move his or her hand position by sliding the hand in a vertical direction (long side direction) without releasing the hand and holding the guide 553 again.

Note that, although the guide 553 is formed not only along the long side direction of the front plate 552A but also formed continuously up to the top plate 552B and the bottom plate 552C as in FIG. 6, which is non-limiting, the guide 553 may be formed only in a section along the long side direction of the front plate 552A.

In the present embodiment, a grip 553C is attached to the guide 553 at the edge of the extension part 553B over its entire length. Therefore, the grip 553C fulfills a slip preventive function, allowing the operator to hook his or her fingers easily on the guide 553, keep his or her hand more stable, and operate the operating switches S more easily. Note that the grip 553C is desirably attached to the guide 553, but it is not required.

An embodiment of the present invention has been described hereinbefore. Note that the present invention is not limited to the foregoing embodiment, and various modifications are included therein. For example, the foregoing embodiment is one described in detail to explain the present invention clearly, and the invention is not necessarily limited to that including all components described. In addition, a subset of the components of the present embodiment may be replaced by components of another embodiment, and components of another embodiment may be added to the components of the present embodiment. Furthermore, for a subset of the components of the present embodiment, other components may be added to the subset or the subset may be removed or replaced by other components.

In the foregoing embodiment, for example, although the guide 553 and the main body 552 are formed integrally, which is non-limiting, the main body 552 and the guide 553 formed of separate materials may be joined by welding or with adhesive among others. In this case, the guide 553 should overhang out from at least one side of the front plate 552A in a short side direction. As the guide, for example, a bent pipe or the like may be provided so as to overhang out from one side of the front plate 552A in a short side direction.

Also in the foregoing embodiment, although the guide 553 is formed in a continuous shape along the long side direction of the switchbox 55, which is not-limiting, the guide may be formed with multiple members that are arranged along the long side direction of the switchbox 55.

Also in the foregoing embodiment, from the viewpoint of operability, the operating surface 550 of the switchbox 55 is placed between the sub-monitor 56 and the operating lever 54; however, it may not necessarily be placed as such.

Also in the foregoing embodiment, although both the operating lever 54 and the switchbox 55 are respectively placed on the right side in front of the driver's seat 51, which is non-limiting, they may be placed on the left side in front of the driver's seat 51 depending on specifications of the wheel loader 1.

REFERENCE SIGNS LIST

1: wheel loader (work vehicle),
1A: front frame,
1B: rear frame,
2: working device,
3: cab,
31: floorboard,
32: ceiling,
51: driver's seat,
54: operating lever,
55: switchbox,
56: sub-monitor (display device),
331L: left front pillar (pillar),
331R: right front pillar (pillar),
550: operating surface,
553: guide,
C: center line,
IL: imaginary line,
S: operating switch.

The invention claimed is:

1. A work vehicle comprising a working device installed on a frame structure constituting a vehicle body and a cab mounted on the frame structure, wherein the cab is provided with a driver's seat mounted on a floorboard, a pair of pillars extending in a vertical direction between a ceiling and the floorboard at left and right sides in front of the driver's seat, an operating lever for operating the working device, and a switchbox having an operating surface in which multiple operating switches are arranged, wherein the operating lever is placed between one pillar of the pair of pillars and the driver's seat in left and right direction of the cab;

the switchbox is installed to the one pillar with its long side direction being along the pillar extension direction and includes a guide overhanging out in one side in a short side direction and formed to be along the long side direction;

in a back side of the guide, a recess continuing along an extension direction of the guide is defined; and;

the operating surface is oriented toward a direction along an imaginary line that passes through the center in its short side direction and extends perpendicular to the surface, the imaginary line intersecting a backrest of the driver's seat and a center line with respect to the left and right direction of the cab.

2. The work vehicle according to claim 1, wherein the guide is formed in a continuous shape along the long side direction.

3. The work vehicle according to claim 1, wherein the cab is provided with a display device disposed in an upper position on the side of the one pillar; and the operating surface of the switchbox is placed between the display device and the operating lever in a vertical direction.

* * * * *